United States Patent [19]

Van Hest

[11] 4,410,146

[45] Oct. 18, 1983

[54] DEVICE FOR FORMING A STORAGE COIL FROM A THREAD SUPPLIED FROM A YARN SUPPLY

[75] Inventor: Cornelis A. J. H. Van Hest, Helmond, Netherlands

[73] Assignee: Ruti-te Strake B.V., Netherlands

[21] Appl. No.: 343,691

[22] Filed: Jan. 28, 1982

[30] Foreign Application Priority Data

Feb. 2, 1981 [NL] Netherlands ..... 8100492

[51] Int. Cl.[3] ..... B65H 51/20

[52] U.S. Cl. ..... 242/47.01; 242/47.12

[58] Field of Search ..... 242/47.01–47.13; 139/452; 66/132 R

[56] References Cited

U.S. PATENT DOCUMENTS 4,238,080 12/1980 Van Mullekom ..... 242/47.12

*Primary Examiner*—Stanley N. Gilreath

*Attorney, Agent, or Firm*—Burns, Doane, Swecker & Mathis

[57] ABSTRACT

A winding drum (8) for forming the storage coils has pins or ribs (11) extending substantially in axial direction of the drum.

In a known winding drum the ends of the pins where the thread coil leaves the drum slightly converge towards the drum axis, thereby forming a conical drum part. According to the invention at least some pins (**11*b*) are parallel to the drum axis which prevents the coil to leave the drum (8**) too abruptly, so that the release pattern of the coils is more uniform.

6 Claims, 2 Drawing Figures

DEVICE FOR FORMING A STORAGE COIL FROM A THREAD SUPPLIED FROM A YARN SUPPLY

Figure 1:
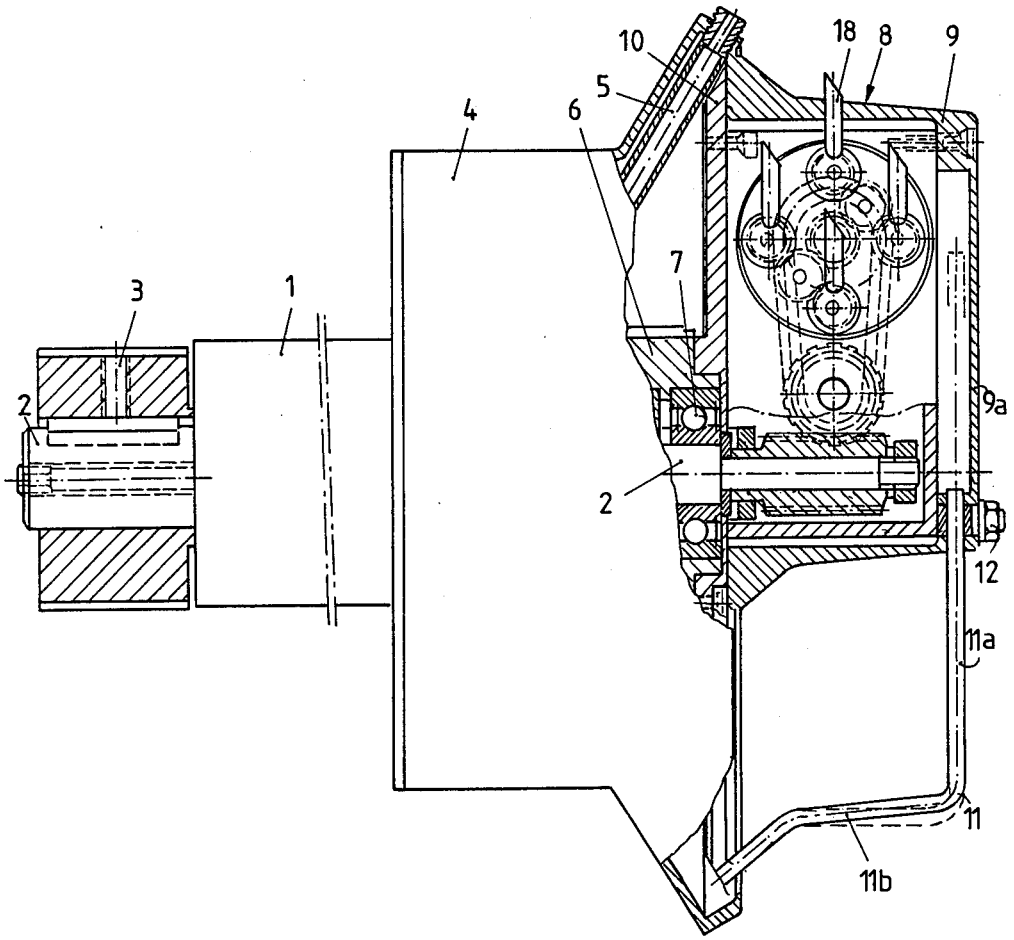

The invention relates to a device for forming a storage coil from a thread supplied from a yarn supply, comprising a winding drum and a thread guide rotatable relative thereto, at least part of the drum sleeve of the winding drum being constituted by pins or ribs extending substantially in axial direction, means being provided for moving in axial direction along the drum the storage coil formed thereon.

Such a device is disclosed in U.S. Pat. No. 4,238,080 issued Dec. 9, 1982 to van Mullekom.

In this known device, a thread coil is sequentially enclosed between two pins exiting from the drum interior outwardly and after axial movement the pins are retracted into the drum interior. As soon as the front pin is retracted into the drum interior the storage coil is free to be drawn away along the front free end surface of the drum.

The drum sleeve or the pins or ribs defining said drum sleeve extend slightly conically whereby the windings of the storage coil formed on the drum, with the movement in axial direction along the drum surface gradually are loosened whereby drawing the winding from the drum is facilitated.

The device according to the invention is characterized in that at least part of the ribs or pins delimiting the sleeve surface of the winding drum extend substantially parallel to the winding drum axis, the remainder of the ribs or pins, as seen in the yarn transport direction, extending slightly convergingly.

Due to said feature the advantage is maintained that the windings of the storage coil formed on the drum with the movement in axial direction are gradually loosened from the sleeve surface of the drum. The ribs or pins extending parallel to the drum axis prevent the storage coil, when released, from leaving the free drum end surface too abruptly. Instead thereof said ribs further ensure that the storage coil is drawn away more uniformly, i.e. winding after winding.

The invention is hereunder further illustrated with reference to the drawing of an embodiment given as an example.

Figure 2:
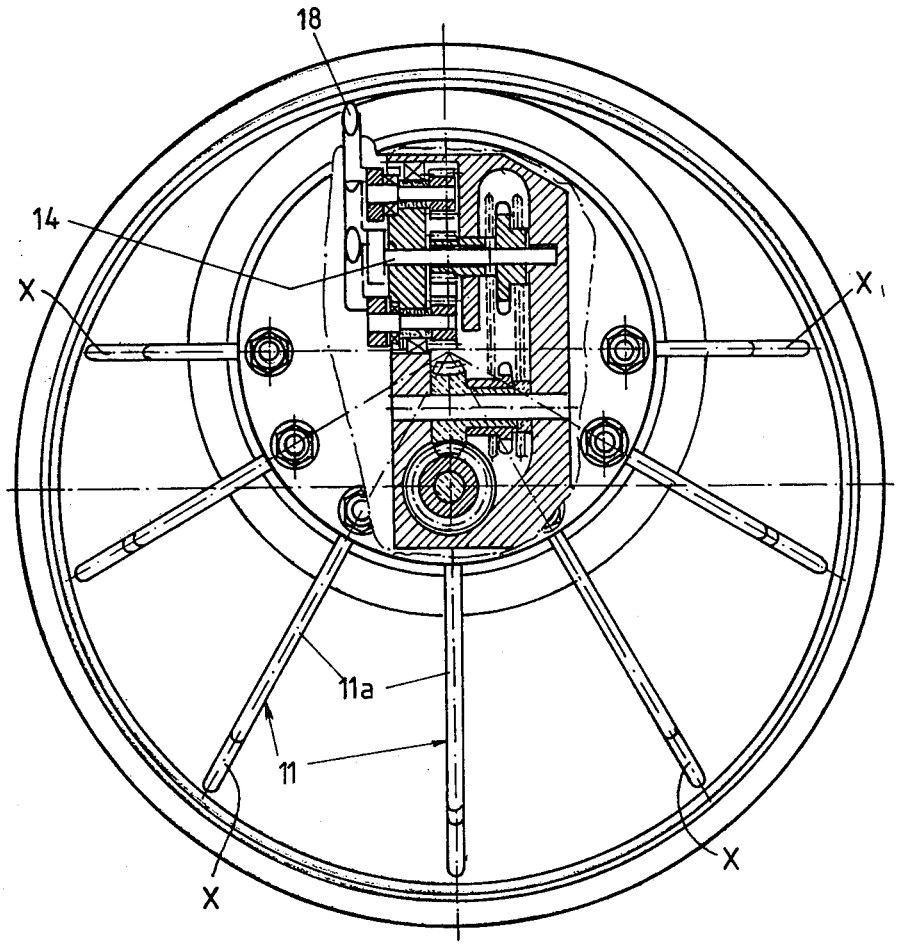

FIG. 1 shows partially in side view and partially in longitudinal section the device according to the invention and FIG. 2 is an end view as seen from the right in FIG. 1.

The device as shown in the drawing is mainly of known construction.

Reference number 1 indicates a sleeve shaped supporting part by means of which the device may be secured to the frame of a yarn processing machine, particularly a shuttleless weaving machine. In this supporting part 1 a shaft 2 is rotatably journalled. On the end of the shaft 2 projecting from the supporting part 1 to the left a pinion 3 has been secured which is drivable through a suitable transmission by a control shaft, not further shown, of the yarn processing machine. Reference number 4 indicates a housing secured to the shaft 2 which therefore is rotatable relative to the stationary supporting part 1 and supports the thread guide constituted by a tube 5.

Reference number 6 indicates a cylindrical hub portion which is rotatably journalled through ball bearings 7 on the shaft 2 and is coupled through a transmission mechanism not further shown and provided within the housing 4 such with the supporting part 1 that it remains stationary while the shaft 2 is rotating.

Reference number 8 indicates the yarn winding drum. Said drum has a slightly conical housing 9 having a circular base and being closed at its right hand end by an end wall **9*a* and is connected with its left hand open end against a disc 10 carried by the hub portion 6. The drum housing 9 has an eccentric position relative to the shaft 2 and remains stationary while the shaft is rotating due to its connection with the hub portion 6. The housing 9 is provided along part of its circumference, in the embodiment under consideration that half of the circumference that is situated closest to the shaft axis, with a plurality of generally L-shaped curved elements 11. The elements 11 are each received with one leg 11*a* adjustable in radial direction in a radial bore in the relative portion of the circumferential edge of the housing 9 and may be fixed with the intermediary of a clamping sleeve 12. The other legs 11*b* of the L-shaped elements have been formed and are directed generally along the generatrices of the housing 9. The legs 11*b* constitute together with the generatrix of the housing situated farthest from the shaft 2** the winding surface of the drum.

It will be clear that for adjusting the L-shaped elements in radial direction the effective winding drum diameter may be increased or decreased in correspondence with the desired yarn length of the yarn coil placed by the thread guide 5 on the drum.

As yet the device as described is of known construction. The difference effected by the invention relates to the modified extension of the second leg **11*b* of a number of the L-shaped curved elements 11**.

As an example the L-shaped upper elements 11 in FIG. 2 which have a modified form according to the invention are indicated by the reference x. Of said elements the second leg **11*b* does not extend, as indicated in FIG. 1 with full lines, slightly conical relative to the winding drum axis but at least approximately, i.e., substantially parallel to said axis. In FIG. 1 this modified extension is indicated by broken lines. It will be clear that due to the thus modified embodiment of at least a number of the elements 11 the drawing of the released yarn coil from the drum is better governable. Moreover, the magnitude of said effect is controllable in that the relative elements 11 may be extended further or less far respectively, relative to the other elements, in radial sense relative to the housing 9**.

For the remainder of the construction of the device, such as the pins 18 which subsequently exit from the interior or the housing 9 when the thread guide 5 rotates and move the storage coil as formed on the drum to the right along the drum surface, reference is made to the above mentioned United States patent.

I claim:

1. A device for forming a storage coil from a thread supplied from a yarn supply, comprising a winding drum and a thread guide rotatable relative to thereto, at least a portion of a drum sleeve of said winding drum being defined by pins or ribs extending substantially in an axial direction of the drum, means for moving the storage coil in the axial direction along the drum, at least a first portion of the ribs or pins defining the winding drum sleeve surface extending parallel to the winding drum axis, the remaining portion of the ribs or pins having, as seen in the yarn transport direction, a slightly convergent extension relative to the drum axis.

2. A device according to claim 1, wherein the ribs or pins extend alternately parallel and convergent relative to the drum axis.

3. A device according to claim 1, wherein one of the first and the remaining portions of the ribs or pins extending parallel or convergent, respectively, are mutually adjustable in a radial direction.

4. A device according to claim 3, wherein the remaining portion comprised of the convergent ribs or pins are fixed and the first portion comprising the ribs or pins extending parallel are adjustable.

5. A device according to claim 1, wherein the remaining portion comprising the ribs or pins extending convergently are adjustable and wherein the first portion comprising the ribs or pins extending parallel are fixedly mounted.

6. A device according to claim 1, wherein all of the ribs or pins are adjustable in a radial direction.

* * * * *